US005537002A

United States Patent [19]

Price et al.

[11] Patent Number: 5,537,002

[45] Date of Patent: Jul. 16, 1996

[54] FREQUENCY TUNABLE MAGNETRON INCLUDING AT LEAST ONE MOVABLE BACKWALL

[75] Inventors: David Price, Fremont; Jerrold S. Levine, Oakland, both of Calif.

[73] Assignee: Olin Corporation, San Leandro, Calif.

[21] Appl. No.: 304,459

[22] Filed: Sep. 12, 1994

[51] Int. Cl.[6] ..... H01J 23/213

[52] U.S. Cl. ..... 315/39.610; 315/39.650; 331/90

[58] Field of Search ..... 315/39.51, 39.53, 315/39.55, 39.61, 39.65; 331/90

[56] References Cited

U.S. PATENT DOCUMENTS

| | | | |
|---|---|---|---|
| 2,808,568 | 10/1957 | Cuccia | 315/39.63 X |
| 2,838,712 | 6/1959 | Briggs | 315/39.61 |
| 2,915,675 | 12/1959 | Vaccaro | 315/39.61 X |
| 3,028,522 | 4/1962 | Pease | 315/39.65 X |
| 3,671,801 | 6/1972 | Masek | 315/39.55 |
| 3,731,140 | 5/1973 | Lewis | 315/39.61 |
| 3,870,923 | 3/1975 | Peyrard et al. | 315/39.55 |
| 4,234,855 | 11/1980 | Busacca et al. | 331/90 |
| 4,751,429 | 6/1988 | Minich | 315/5 |
| 4,817,102 | 3/1989 | Maurer et al. | 372/45 |
| 4,831,341 | 5/1989 | Brady | 331/90 |
| 5,041,801 | 8/1991 | Squibb | 331/90 |
| 5,182,493 | 1/1993 | Robertson | 315/39.61 |

FOREIGN PATENT DOCUMENTS

| | | | |
|---|---|---|---|
| 554552 | 3/1958 | Canada | 315/39.61 |

OTHER PUBLICATIONS

Farney, "Crossed-Field Tubes", appearing in Electronics Enginners' Handbook, Donald G. Fink, Editor in Chief, at pp. 9–46 through 9–60, published by Mc-graw Hill Book company, 1975.

*Primary Examiner*—Benny T. Lee
*Attorney, Agent, or Firm*—Gregory S. Rosenblatt

[57] ABSTRACT

There is provided a tunable high power magnetron. An annular anode circumscribes a cathode and contains a plurality of resonating cavities. The volume of the resonating cavities determines the output frequency of the RF energy emitted by the magnetron. The volume of the cavities is varied by changing the position of movable, electrically conductive back walls.

16 Claims, 4 Drawing Sheets

FREQUENCY TUNABLE MAGNETRON INCLUDING AT LEAST ONE MOVABLE BACKWALL

This invention relates to magnetrons and more particularly, to high power magnetrons capable of being mechanically tuned over large ranges of output frequency.

BACKGROUND OF THE INVENTION

A magnetron microwave oscillator is composed of a cathode and a surrounding coaxial anode. The anode has a multiplicity of resonant cavities that interact with azimuthally circulating electron bunches emitted from the cathode to generate microwave radiation. The microwave frequency is principally determined by the dimensions and number of resonant cavities, the magnitude of an externally applied magnetic field and the voltage between the cathode and the anode.

A number of methods exist to tune the frequency of a magnetron. U.S. Pat. No. 3,671,801 to Masek discloses a tunable magnetron. A spring loaded plunger inserts a tuning rod into a resonating anode cavity. U.S. Pat. No. 5,182,493 to Robertson discloses a tunable rising sun magnetron. A tuning plate is extendable into a number of resonant cavities to change the dimensions of a number of adjacent cavities. Both the Masek and the Robertson patent are incorporated by reference herein in their entireties.

Both of the above techniques produce small perturbations in resonance and produce correspondingly small frequency changes. This benefit is at the expense of increased susceptibility to starting instabilities and arcing due to the tuning mechanism occupying a portion of the resonant cavity volume.

Coaxial magnetrons, as disclosed in U.S. Pat. No. 5,041,801 to Squibb, are tuned by moving a plunger in an externally coupled cavity. This eliminates the limitations of the conventionally tuned magnetrons, but the tunable range and output power are both still restricted by the requirement that the external cavity Q-value (a measurement of oscillation quality, measures the RF losses in the external cavity) must be high enough to efficiently store the microwave energy from the magnetron proper.

There remains, therefore, a need for a magnetron that is tunable over a wide range of output frequencies without a limitation imposed on the output power.

SUMMARY OF THE INVENTION

Accordingly, it is an object of the invention to provide a magnetron having a broad tuning range in which the output microwave power is substantially independent of the frequency within the tuning band. The magnetron provides a microwave source for applications requiring a continuously and broadly tunable, narrow band spectrum.

It is a feature of the invention that tuning is accomplished by radial translation of the backwalls of a first of two interleaved, alternating sets of resonator cavities. Another feature is that this translation is accomplished by independently connecting each of the movable resonator back walls to a linear motion vacuum feedthrough. Still another feature is that microwave energy is extracted from the magnetron via axial slots in the back wall of one or more fixed resonators selected from the second of the two interleaved, alternating sets of resonator cavities.

It is an advantage of the present invention that the tunable magnetron decouples the tuning of the magnetron from both the output power of the magnetron and the electrical impedance of the magnetron. Another advantage is that a mechanism is provided to decouple the tuning of the magnetron from the extraction coupling of the magnetron. Still another advantage is that the tuning mechanism is capable of operating at high radio frequency power levels.

In accordance with the invention, there is provided a frequency tunable magnetron. The magnetron has an annular anode containing a plurality of inwardly extending fingers defining first and second alternating sets of interleaved cavities and a cathode, coaxial with and surrounded by the anode. A separate electrically conductive backwall of each cavity forming the first set of cavities is independently movable both toward and from the cathode. An electrical interconnection is provided between the anode and the backwalls.

The above stated objects, features and advantages will become more apparent from the specification and drawings that follow.

DETAILED DESCRIPTION

Figure 1:
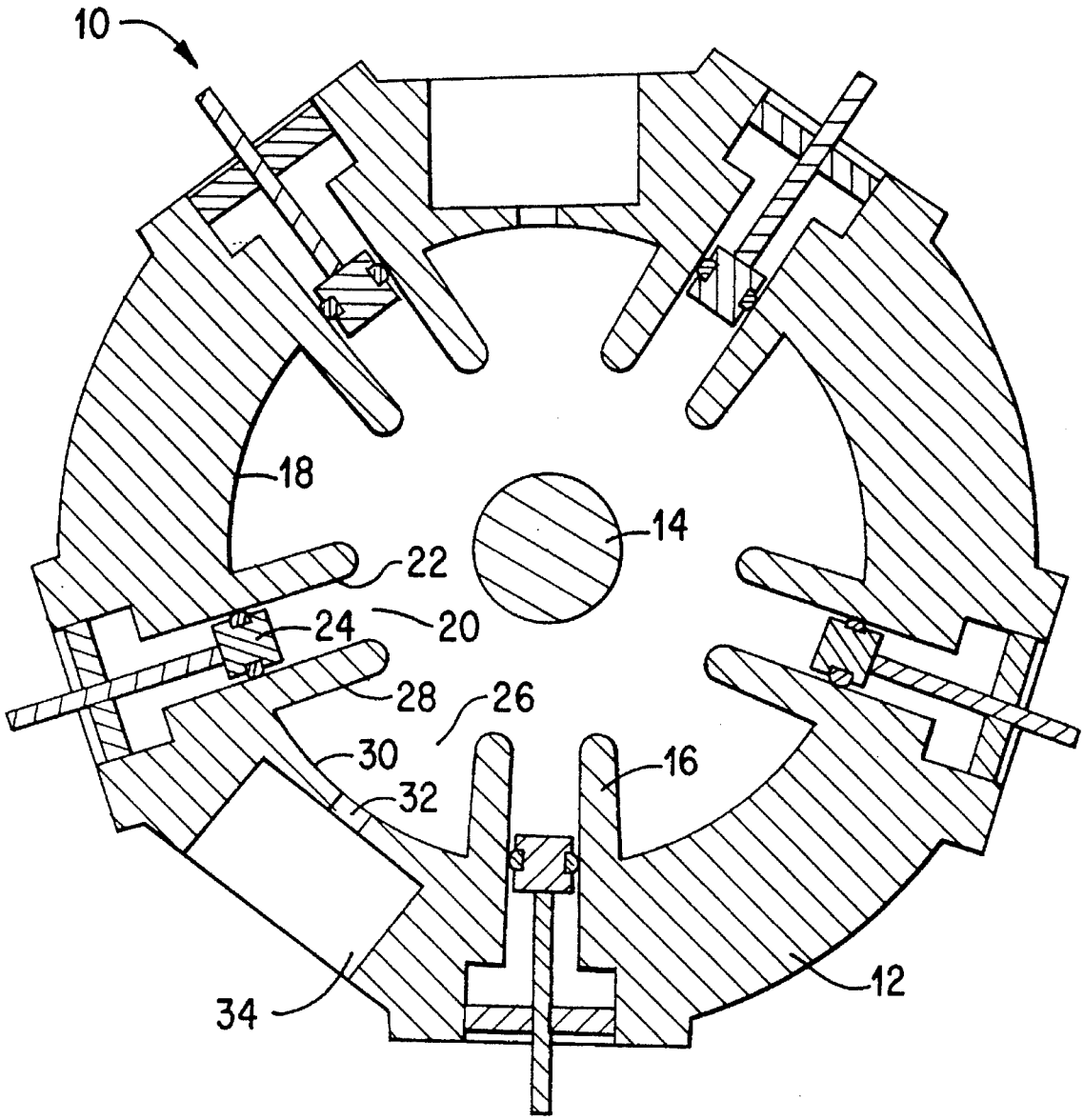
FIG. 1 shows in cross-sectional representation a tunable magnetron in accordance with the invention.

FIG. 1 shows in cross-sectional representation a tunable magnetron 10 in accordance with the invention. The magnetron 10 has an annular anode 12 surrounding a cathode 14. The anode 12 and cathode 14 are coaxial about a major axis that is perpendicular to the cross-sectional view of FIG. 1. The anode 12 and the cathode 14 may be formed from any suitable, electrically conductive, material. Typically, the anode is formed from 304L stainless steel and the cathode from 304L stainless steel.

The cathode 14 is usually rod shaped, cylindrical in cross-section and axially uniform. However, nonuniformities in either cross-section or in axial shape may be incorporated into the cathode design as described below.

Fingers 16 extend inward from an interior surface 18 of the anode 12 forming two alternating interleaved sets of cavities 20,26 of differing structure. This configuration is commonly referred to as a "rising sun" geometry.

A first set of cavities 20 has generally parallel side walls 22. The cavities 20 are tunable by translation of a movable backwall 24 that is generally perpendicular to the side walls 22. Alternating with the first set of cavities 20 is a second set of cavities 26. The second set of cavities has non-parallel side walls 28 and a fixed arcuate backwall 30.

Axial slots 32 in the fixed arcuate back walls 30 of one or more of the second set cavities 26 couple radio frequency energy from the magnetron 10 to a waveguide (not shown) connected, for example, to a port 34. Alternatively, rather than the axial slots 32, extraction of the microwave energy may be through either electromagnetic pick-up loops in any number of cavities or through axial couplers.

The magnetron 10 operates in conventional fashion. The interior of the assembly is maintained at high vacuum by vacuum pumps (not shown) and an axial magnetic field is supplied by a pair of magnet coils. The magnetic field runs parallel to the longitudinal axis of the cathode 14.

Negative high voltage, on the order of from about 1000 volts to about 1,000,000 volts, applied to the cathode 14 causes an emission of electrons. The cathode emission may be based on a field emission process or on a thermionic or secondary emission process.

The electrons are collected on the anode fingers 16. With the proper selection of the applied voltage and magnetic field, a resonant interaction will occur whereby the energy of the electrons is transferred to an electromagnetic mode of the interleaved cavity structure 20,26 and the annular region bounded by the fingers 16 and the cathode 14.

¥ is defined as the electrical admittance of the annular interaction region between the cathode 14 and anode fingers 16. The admittances for the interaction region of the fixed second cavities 26 are functions of the frequency and their unchanging geometry.

The admittance per unit length of each cavity of the tunable first cavity set 20 is:

$$\frac{¥}{h} = \frac{-j}{(\mu_0/\epsilon_0)^{0.5} d} \cot kl \qquad (1)$$

J is $\sqrt{-1}$.

k=w/c=the wave number.

1 is the depth of the cavity 20.

h is the height of the cavity 20.

$\mu_o$ is the permeability of free space.

$\epsilon_o$ is the permittivity of free space.

d is the width of the cavity 20.

From equation (1), it is determined that changing "1" will tune the frequency at which resonance occurs.

Typically the RF energy is on the order of from about 1 kilowatt to about 1 gigawatt. This RF energy may be tapped from the magnetron by the waveguide attached to one or more of the ports 34.

The resonant frequency established by the first set of cavities 20 is varied by changing the volume of the cavities. This is accomplished by moving the movable backwall 24, thereby changing "1".

Figure 2:
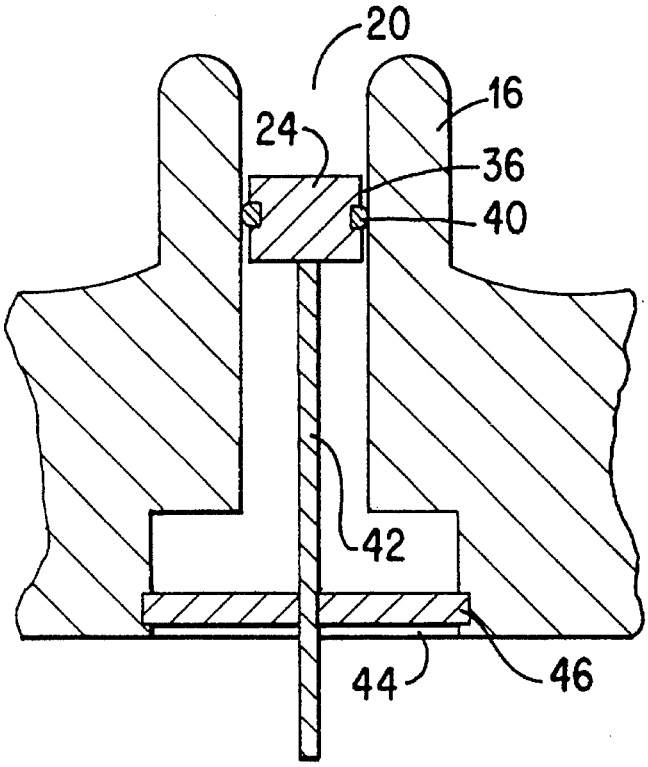
FIG. 2 shows in cross-sectional representation a tunable resonant cavity in accordance with the invention.
Figure 3:
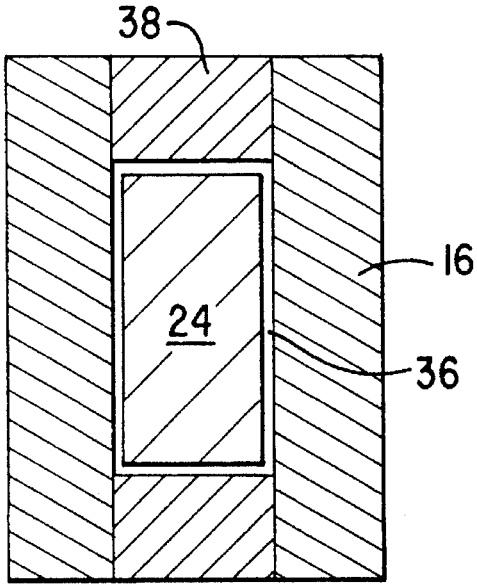
FIG. 3 shows in frontal view the tunable resonant cavity of FIG. 2.

With reference to FIG. 2, the volume of the cavity 20 is varied by movement of the backwall 24. The backwall 24 is formed from any suitable electrically conductive material and is preferably 304L stainless steel. Unlike low powered magnetrons in which the backwall may be either a conductor or a dielectric, the backwall in high power devices, typical output in excess of 100 megawatts, must be a conductor. Dielectrics breakdown at this power level. The backwall 24 is sized to fit closely within the cavity 20. A gap 36 between the fingers and backwall 24 is large enough to insure the backwall moves freely without perturbing the RF boundary condition at the back of the resonant cavities. As shown in FIG. 3, the gap 36 is maintained both between the fingers 16 and the backwall 24 and annular end caps 38 defining a top and a bottom to the cavities. The top and bottom of the cavities are generally perpendicular to both the side walls 22 and to the backwall 24.

Referring back to FIG. 2, electrical contact between the backwall 24 and the fingers 16 is maintained by bushings 40. The bushings 40 may be any electrically conductive material that will allow free movement of the backwall 24 while contacting the fingers 16. Suitable materials include copper and copper alloy fingerstock, stainless steel roller bearings, flexible metal gaskets and spring loaded gaskets. Beryllium-copper alloys are most preferred.

The backwalls 24 of the first cavities 20 are translated radially by shafts 42 driven by any controllable movement source, such as linear motion vacuum feedthroughs (not shown). Each backwall 24 may be independently movable or, a series, or all, backwalls may be movable in concert.

The shafts 42 exit the evacuated magnetron core through ports 44. A gasket 46 such as a stainless steel bellows prevents the ingress of air at the ports 44. Tuning is accomplished by changing the depth of the resonator and thereby, the resonant frequency. It is preferred, but not required, that all backwalls 24 are adjusted for the same radial position.

The AK gap (i.e., the difference between anode radius and cathode radius) remains constant. As a result, the electrical impedance does not change during tuning. Increased impedance causes a drop off in power and limits the tunable range.

Because extraction is through the axial slots of the fixed resonators, the tunable magnetron 10 decouples the tuning of the magnetron from the microwave extraction. A net result of the two preceding features is that the output power is largely independent of the resonant frequency within the operational band.

Figure 4:
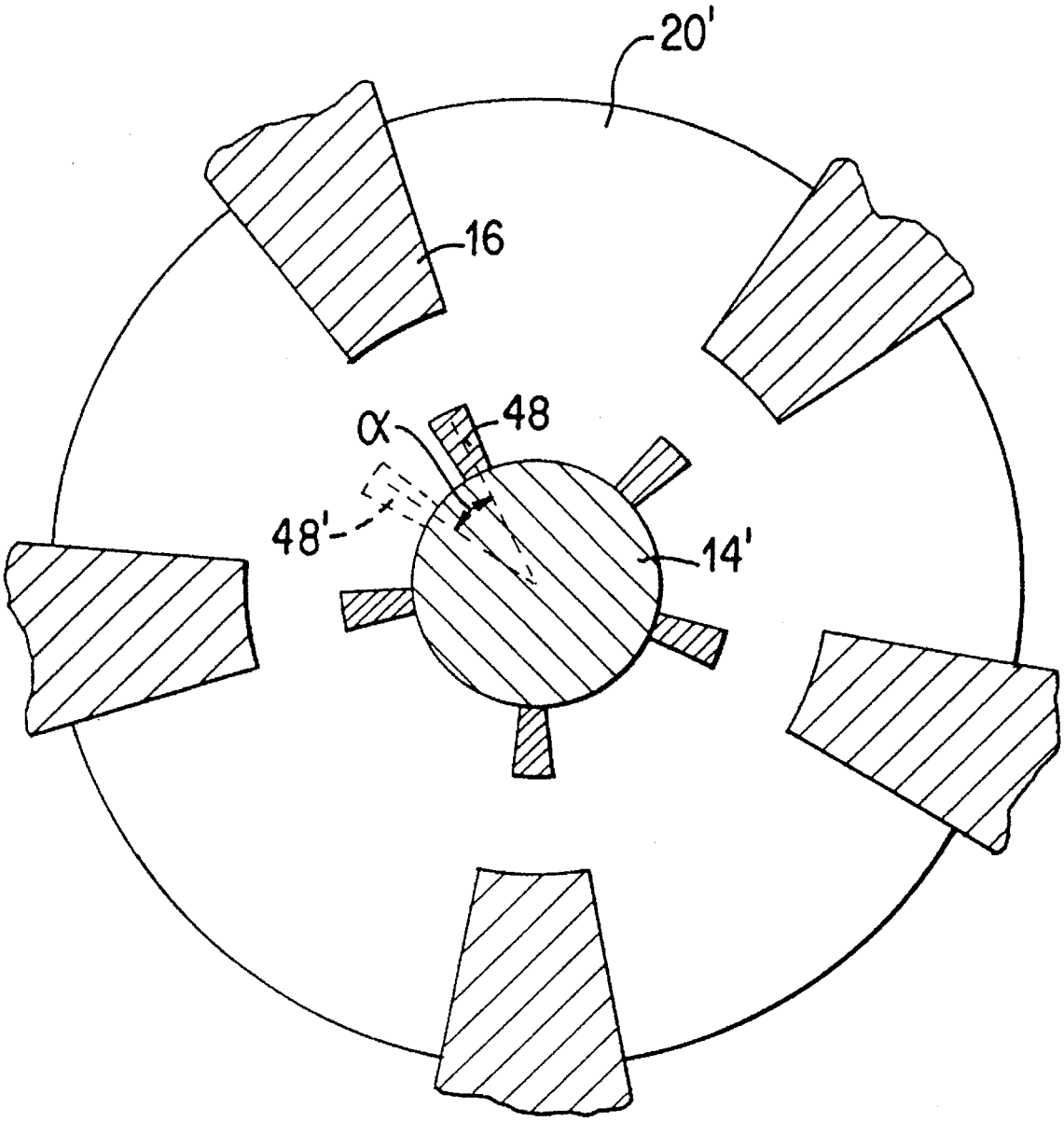
FIG. 4 shows in cross-sectional representation a tunable magnetron in accordance with a second embodiment of the invention.

In a second embodiment of the invention, as illustrated in cross-sectional representation in FIG. 4, the cathode 14' has a plurality of electrically conductive pins 48 extending radially therefrom. The pins 48 are preferably formed from the same material as the cathode. The pins enhance cathode emissivity relative to that of a cylindrical cathode. The pins aid the azimuthal electron bunching process and are less susceptible to electron back bombardment and cathode plasma expansion.

The cathode is rotatable about a major axis so that the pins may be rotated from pointing at anode fingers 16 to pointing at the center of a resonating cavity 20'. The resonating cavity 20' may be fixed or tunable. This rotation, as indicated by broken line pin 48' extends through an angle, α, of about 30°.

Rotating the pins 48 toward the center of a resonating cavity 20' decreases the capacitance, C, and inductance, L, leading to an increase in frequency, f.

$$f = 1/2\pi \sqrt{(1/C)/L} \qquad (2)$$

A further effect of rotating the pins 48 is the electric field assumes an azimuthal component producing a radial E×B component. This repositions the electron cloud further altering the RF field boundary conditions and resulting resonant frequency.

The benefits of the present invention will be more apparent from the Examples that follow. The Examples are exemplary and not intended to limit the scope of the invention.

EXAMPLES

Figure 5:
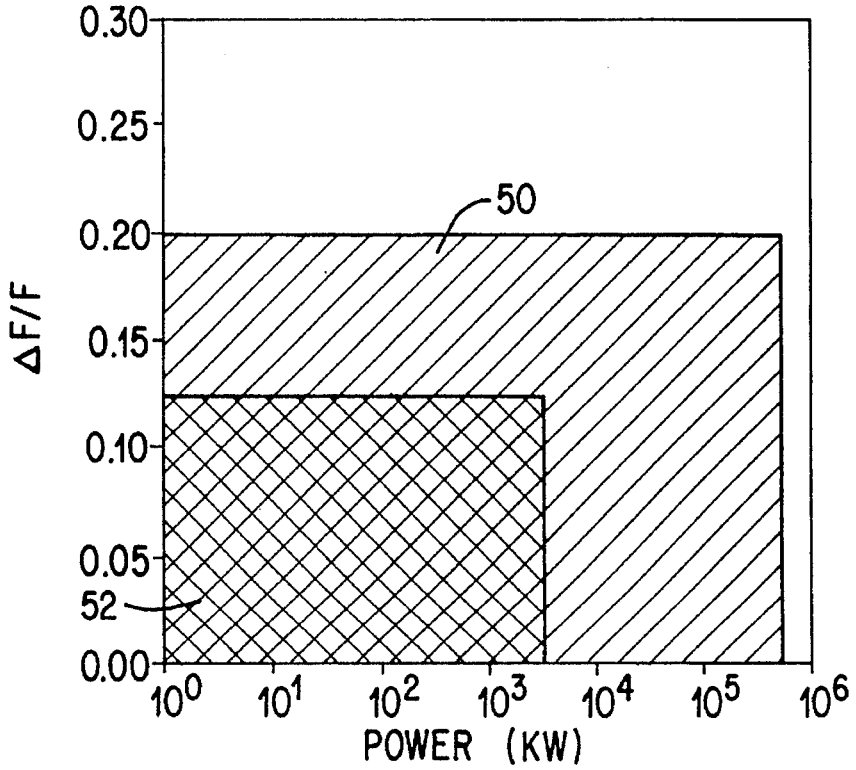
FIG. 5 graphically compares the performance parameters of an L-band manifestation of the magnetron of the invention to conventionally tunable magnetrons.

FIG. 5 graphically compares the peak power and tunable range (normalized to the center microwave frequency) parameter space characteristic of the magnetron 10 of the invention (hatched region 50) to that commercially available (double hatched region 52) from several well known magnetron suppliers. This illustrates the extension of tunable magnetron performance to broader tunable ranges and higher powers provided by this invention.

Figure 6:
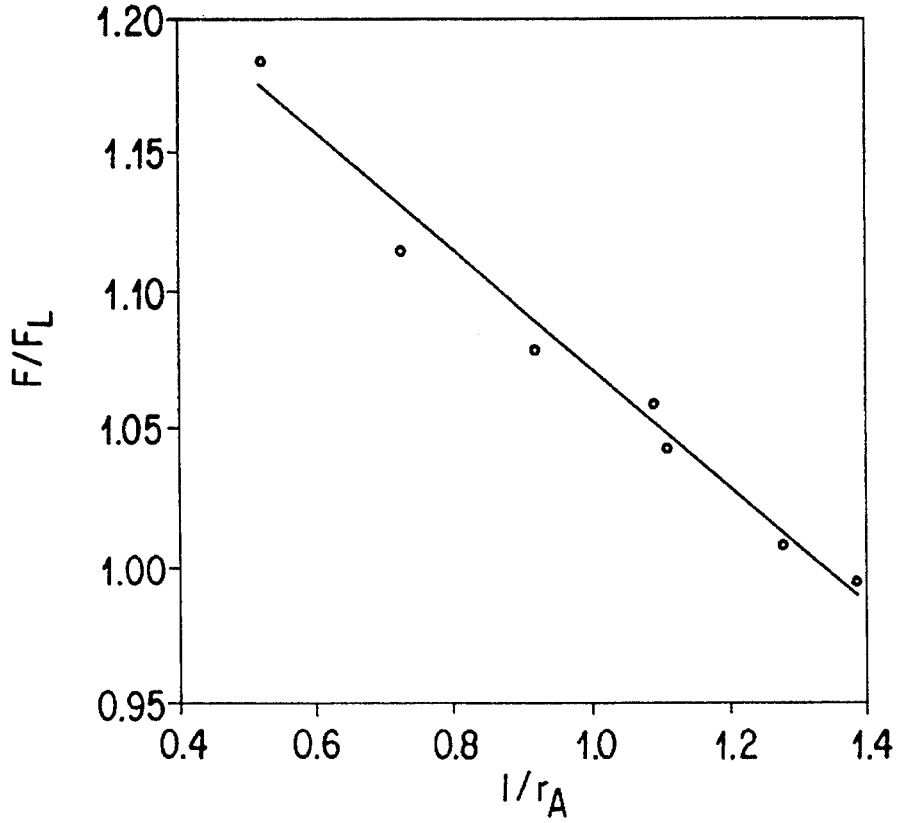
FIG. 6 graphically illustrates the measured normalized output frequency of the magnetron of the invention as a function of normalized cavity depth.

FIG. 6 graphically illustrates the measured normalized output frequency $F/F_L$ (where F is the frequency at the normalized cavity depth and $F_L$ is the frequency at the maximum cavity depth) as a function of the normalized cavity depth $l/r_A$ (where $r_A$ is anode radius as measured from the center of the cathode to the tips of the anode fingers). The present invention achieved a 19% continuous frequency tuning range at output powers between 350 MW and 500 MW in the L-band.

It is apparent that there has been provided in accordance with this invention, a tunable high power magnetron that fully satisfies the objects, features and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A frequency tunable magnetron, comprising:

an annular anode containing a plurality of inwardly extending fingers defining first and second alternating sets of interleaved cavities therebetween;

each of said first set of cavities having respective ones of said fingers defining two generally parallel sidewalls and corresponding electrically conductive backwalls that are generally perpendicular to said parallel sidewalls and are separated from said sidewalls by a respective gap having a size effective to permit unimpeded movement of said backwalls without perturbing the RF boundary condition, wherein all of said backwalls are movable together toward and from a cathode; and each one of said second set of cavities having respective non-parallel sidewalls and corresponding fixed arcuate backwalls; and said cathode being coaxial with and surrounded by said anode.

2. A frequency tunable magnetron, comprising:

an annular anode containing a plurality of inwardly extending fingers defining first and second alternating sets of interleaved cavities therebetween;

a cathode, coaxial with and surrounded by the anode;

a separate electrically conductive backwall of each first cavity defining, in combination with said respective fingers thereof, said first set of cavities, each of said first cavities having respective ones of said fingers defining two generally parallel sidewalls and said corresponding backwall being generally perpendicular to said parallel sidewalls, with each said backwall being independently moveable both toward and from said cathode;

at least one end cap perpendicular to both said sidewalls and said backwall; and a respective electrical interconnection between said anode and each said backwall.

3. The magnetron of claim 2 wherein at least one cavity of said second set of cavities has an axial slot disposed therein for extraction of microwaves generated by said frequency turnable magnetron.

4. The magnetron of claim 2 wherein each one of said second set of cavities have respective non-parallel sidewalls and a corresponding fixed arcuate backwall.

5. The magnetron of claim 2 wherein a respective flexible bushing provides electrical interconnection between said respective sidewalls and said corresponding backwall.

6. The magnetron of claim 5 wherein each said bushing is comprised of a flexible strip of copper alloy fingerstock.

7. The magnetron of claim 6 wherein each said bushing is comprised of a beryllium copper alloy.

8. The magnetron of claim 2 wherein said cathode is generally cylindrical in cross section and contains non-uniformities in axial shape.

9. The magnetron of claim 8 wherein said generally cylindrical cathode includes a plurality of pins extending radially outwardly toward said fingers.

10. The magnetron of claim 9 wherein said cathode is rotatable about a major axis aligned along the cathode.

11. The magnetron of claim 10 wherein a direction of said pins varies from an orientation outward towards said fingers to an orientation outward towards a central portion of said respective first cavities.

12. A frequency tunable magnetron, comprising:

an annular anode containing a plurality of inwardly extending fingers defining first and second alternating sets of interleaved cavities therebetween;

each of said first set of cavities having respective ones of said fingers defining two generally parallel sidewalls and corresponding electrically conductive backwalls that are generally perpendicular to said parallel sidewalls and are separated from said sidewalls by a respective gap having a size effective to permit unimpeded movement of said backwall without perturbing the RF boundary condition, wherein each of said backwalls is independently movable both toward and from a cathode; and each one of said second set of cavities having respective non-parallel sidewalls and a corresponding fixed arcuate backwall;

said cathode being coaxial with and surrounded by said anode; and at least one pick up loop respectively located within one or more cavities of said first and second sets of cavities for extraction of microwaves generated by said frequency tunable magnetron.

13. A frequency tunable magnetron, comprising:

an annular anode containing a plurality of inwardly extending fingers defining first and second alternating sets of interleaved cavities therebetween;

each of said first set of cavities having respective ones of said fingers defining two generally parallel sidewalls and corresponding electrically conductive backwalls that are generally perpendicular to said parallel sidewalls and are separated from said sidewalls by a respective gap having a size effective to permit unimpeded movement of said backwalls without perturbing the RF boundary condition, wherein a series of said backwalls is movable together toward and from a cathode; and each one of said second set of cavities having respective non-parallel sidewalls and corresponding fixed arcuate backwalls; and said cathode being coaxial with and surrounded by said anode.

14. A frequency tunable magnetron, comprising:

an annular anode containing a plurality of inwardly extending fingers defining cavities therebetween;

a cathode, rotatable about a major axis that is aligned along said cathode, coaxial with and surrounded by the anode; and a plurality of pins extending radially outwardly from said cathode toward said fingers.

15. The magnetron of claim 14 wherein a direction of said pins varies from an orientation outward towards said fingers to an orientation outward towards a central portion of said respective cavities.

16. The magnetron of claim 15 wherein said cylindrical cathode is rotatable through an arc of from about 25° to about 35°.

* * * * *